US011784400B2

(12) United States Patent
Tsuchiya

(10) Patent No.: US 11,784,400 B2
(45) Date of Patent: Oct. 10, 2023

(54) THIN ANTENNA

(71) Applicant: Yazaki Corporation, Tokyo (JP)

(72) Inventor: Kazuhiko Tsuchiya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 48 days.

(21) Appl. No.: 17/523,290

(22) Filed: Nov. 10, 2021

(65) Prior Publication Data

US 2022/0149514 A1 May 12, 2022

(30) Foreign Application Priority Data

Nov. 11, 2020 (JP) ..... 2020-187827

(51) Int. Cl.

| | |
|---|---|
| ***H01Q 1/38*** | (2006.01) |
| ***H01Q 5/15*** | (2015.01) |
| ***H01Q 1/42*** | (2006.01) |
| ***H01Q 9/04*** | (2006.01) |

(52) U.S. Cl.

CPC ..... *H01Q 1/38* (2013.01); *H01Q 1/422* (2013.01); *H01Q 5/15* (2015.01); *H01Q 9/0414* (2013.01)

(58) Field of Classification Search

CPC ..... H01Q 1/38; H01Q 5/15; H01Q 1/422; H01Q 9/0414; H01Q 19/185; H01Q 15/142; H01Q 9/30; H01Q 15/14

See application file for complete search history.

(56) References Cited

U.S. PATENT DOCUMENTS 4,565,979 A * 1/1986 Fiedziuszko ..... H03B 5/1876 333/234
4,707,700 A * 11/1987 Nagy ..... H01Q 1/3275 343/712
4,864,320 A * 9/1989 Munson ..... H01Q 19/06 343/834
4,987,421 A * 1/1991 Sunahara ..... H01Q 9/0464 343/769
5,438,338 A * 8/1995 Thill ..... H01Q 1/1285 343/860

(Continued)

FOREIGN PATENT DOCUMENTS

CN 102800927 B * 5/2016 ..... H01Q 1/241
CN 111092297 A * 5/2020 ..... H01Q 1/36

(Continued)

*Primary Examiner* — Dimary S Lopez Cruz
*Assistant Examiner* — Jordan E. DeWitt
(74) *Attorney, Agent, or Firm* — Sughrue Mion, PLLC

(57) ABSTRACT

A thin antenna includes an antenna element, a first spacer, a second spacer, a first ground plane and a second ground plane. The antenna element is formed in a column shape, and has a top surface and a bottom surface facing each other. The first and second spacers are made of an insulating material. The first ground plane is formed larger than the top surface of the antenna element. The second ground plane is formed larger than the bottom surface of the antenna element. The first ground plane is disposed to face the top surface of the antenna element via the first spacer. The second ground plane is disposed to face the bottom surface of the antenna element via the second spacer. A power is fed at one of the top surface and the bottom surface of the antenna element.

4 Claims, 4 Drawing Sheets

(56) References Cited

U.S. PATENT DOCUMENTS 6,087,990 A * 7/2000 Thill ..... H01Q 21/28 343/700 MS
6,160,512 A * 12/2000 Desclos ..... H01Q 9/32 343/700 MS
6,320,548 B1 * 11/2001 Harrell ..... H01Q 1/38 343/770
6,850,191 B1 * 2/2005 Thill ..... H01Q 5/40 343/700 MS
7,113,136 B2 * 9/2006 Marx ..... H01Q 1/40 343/703
7,609,217 B2 * 10/2009 Noro ..... H01Q 1/1271 343/711
8,669,903 B2 * 3/2014 Thill ..... H01Q 9/0421 343/700 MS
9,490,547 B2 * 11/2016 Chernokalov ..... H01Q 19/06
9,647,328 B2 * 5/2017 Dobric ..... H01Q 9/0428
9,825,373 B1 * 11/2017 Smith ..... H01Q 21/0006
9,882,286 B1 * 1/2018 Tonn ..... H01Q 15/0086
10,461,438 B2 * 10/2019 Shen ..... H01Q 3/34
2004/0222935 A1 * 11/2004 Jan ..... H01Q 9/36 343/790
2004/0263406 A1 * 12/2004 Colburn ..... H01Q 9/27 343/895
2005/0017903 A1 * 1/2005 Ittipiboon ..... H01Q 5/40 343/700 MS
2006/0022056 A1 * 2/2006 Sakama ..... G06K 19/07771 235/492
2006/0038723 A1 * 2/2006 Watanabe ..... H01Q 1/1271 343/846
2007/0247382 A1 * 10/2007 Wan ..... H01Q 9/32 343/729
2009/0289852 A1 * 11/2009 Li ..... H01Q 1/3291 343/700 MS
2010/0097286 A1 * 4/2010 Morrow ..... H01Q 21/28 343/810
2010/0103049 A1 * 4/2010 Tabakovic ..... H01Q 9/0457 343/893
2011/0006957 A1 * 1/2011 Scire-Scappuzzo ..... H01Q 9/16 343/810
2012/0028459 A1 * 2/2012 Lee ..... H05K 3/4652 257/E21.586
2013/0009851 A1 * 1/2013 Danesh ..... H01L 31/075 343/904
2013/0050040 A1 * 2/2013 Libonati ..... H01Q 9/28 343/773
2013/0082879 A1 * 4/2013 Fuchs ..... H01Q 5/328 343/700 MS
2013/0178170 A1 * 7/2013 Schrabler ..... H01Q 1/3275 343/837
2013/0306882 A1 * 11/2013 Komrakov ..... H01Q 15/16 250/492.1
2015/0015447 A1 * 1/2015 Yona ..... H01Q 9/40 343/786
2015/0155630 A1 * 6/2015 Jiang ..... H01Q 9/0464 343/700 MS
2017/0346194 A1 * 11/2017 Chamberland ..... H01Q 9/18
2018/0198202 A1 * 7/2018 Shor ..... H01Q 1/42
2021/0203072 A1 * 7/2021 Wu ..... H01Q 9/0414

FOREIGN PATENT DOCUMENTS

JP 52-83052 A 7/1977
JP 2009-17250 A 1/2009
WO WO-9950932 A1 * 10/1999 ..... H01Q 1/084

* cited by examiner

THIN ANTENNA

CROSS-REFERENCE TO RELATED APPLICATIONS

The present application is based on, and claims priority from Japanese Patent Application No. 2020-187827, filed on Nov. 11, 2020, the entire contents of which are incorporated herein by reference.

TECHNICAL FIELD

The disclosure relates to a thin antenna that can transmit and receive a vertical polarization.

BACKGROUND

As a conventional thin antenna, there has been known an antenna device disclosed in Patent Document 1 (JP 2009-17250). The antenna device is an inverted L-shaped antenna whose the height is reduced. The antenna device includes a base material, an antenna element, and a matching circuit. The base material is provided with a feeding point. The antenna element stands on the base material. The matching circuit is disposed between the feeding point and the antenna element and performs impedance matching. The antenna device has a round directional radiation pattern with little concavity in a vertical polarization (V polarization) relative to a horizontal plane (X-Y plane)

SUMMARY

However, an average gain of the antenna device is −13.39 dBi in the vertical polarization, which has significantly degraded the radiation characteristics.

The disclosure has been made in view of such a conventional problem, and it is an object of the disclosure to provide a thin antenna whose the height is reduced, suitable for use as an on-vehicle antenna having good radiation characteristics in a vertical polarization relative to a horizontal plane.

According to an embodiment, there is provided a thin antenna including: an antenna element formed in a column shape, and having a top surface and a bottom surface facing each other; a first spacer made of an insulating material; a second spacer made of an insulating material; a first ground plane formed larger than the top surface of the antenna element; and a second ground plane formed larger than the bottom surface of the antenna element, wherein the first ground plane is disposed to face the top surface of the antenna element via the first spacer, the second ground plane is disposed to face the bottom surface of the antenna element via the second spacer, and a power is fed at one of the top surface and the bottom surface of the antenna element.

According to an embodiment, it is possible to provide a thin antenna whose the height is reduced, suitable for use as an on-vehicle antenna having good radiation characteristics in a vertical polarization relative to a horizontal plane.

DETAILED DESCRIPTION

Figure 1:
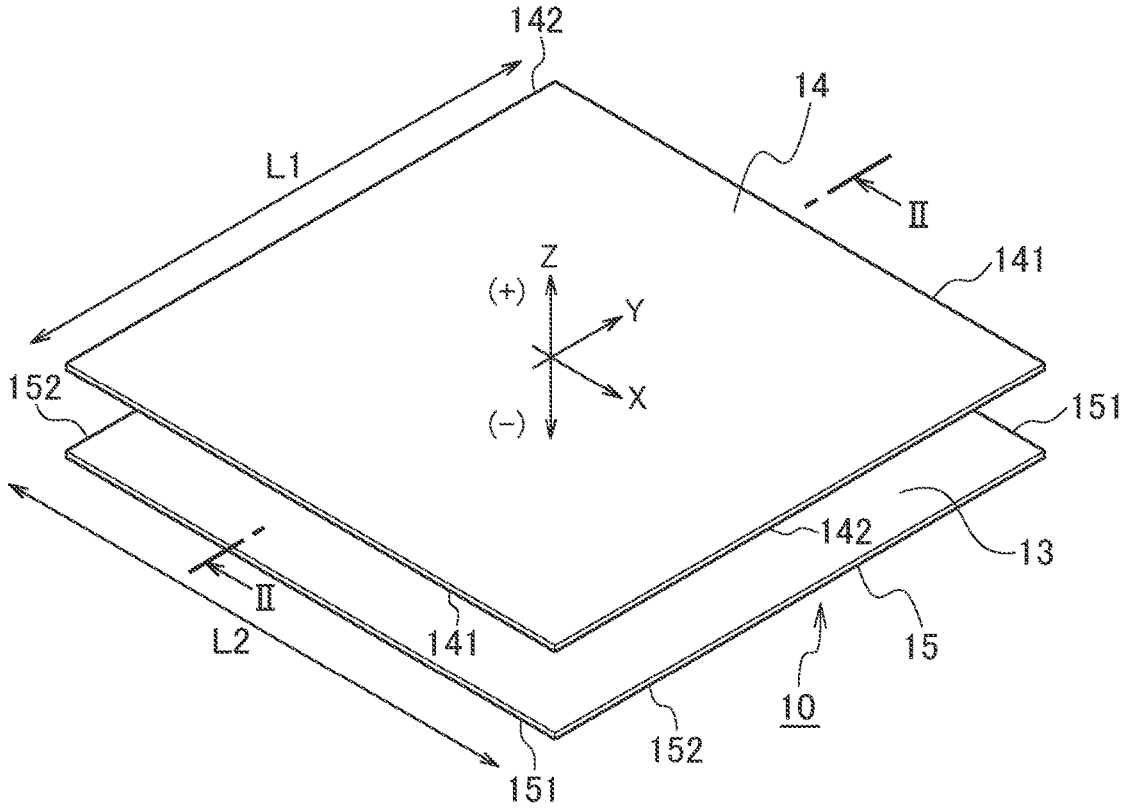
FIG. 1 is a perspective view of a thin antenna according to the present embodiment.

A thin antenna according to an embodiment will be described below with reference to the accompanying drawings. Note that the dimensional ratios in the drawings are exaggerated for convenience of explanation and may differ from the actual ratios.

Figure 2:
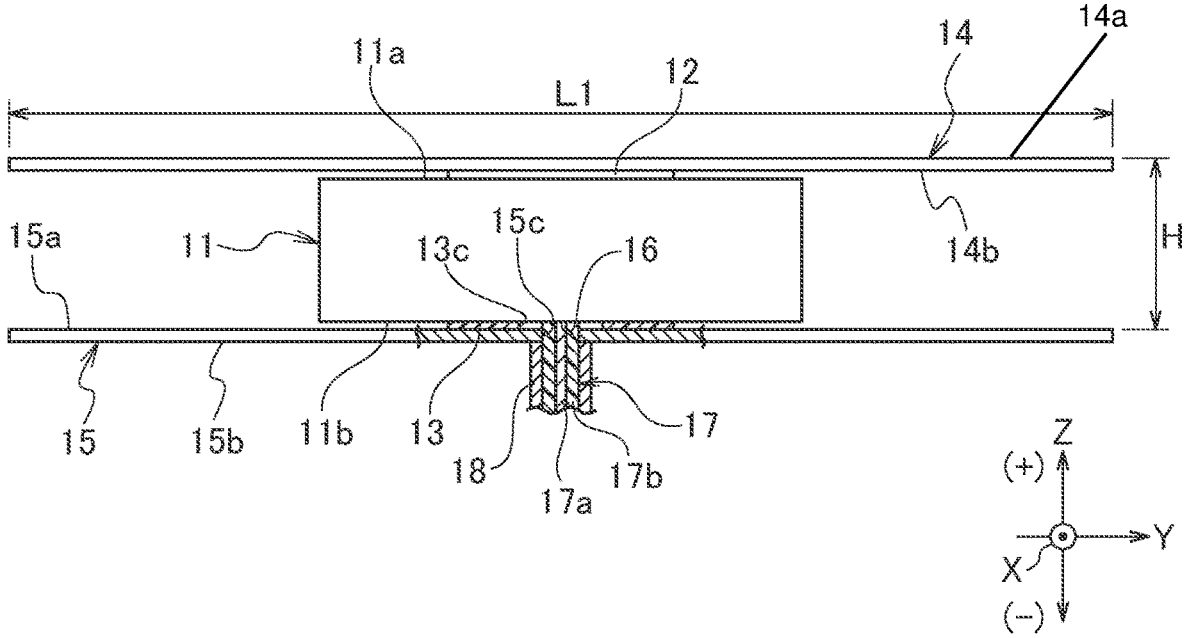
FIG. 2 is a cross-sectional view of the thin antenna along the line II-II of FIG. 1.
Figure 3:
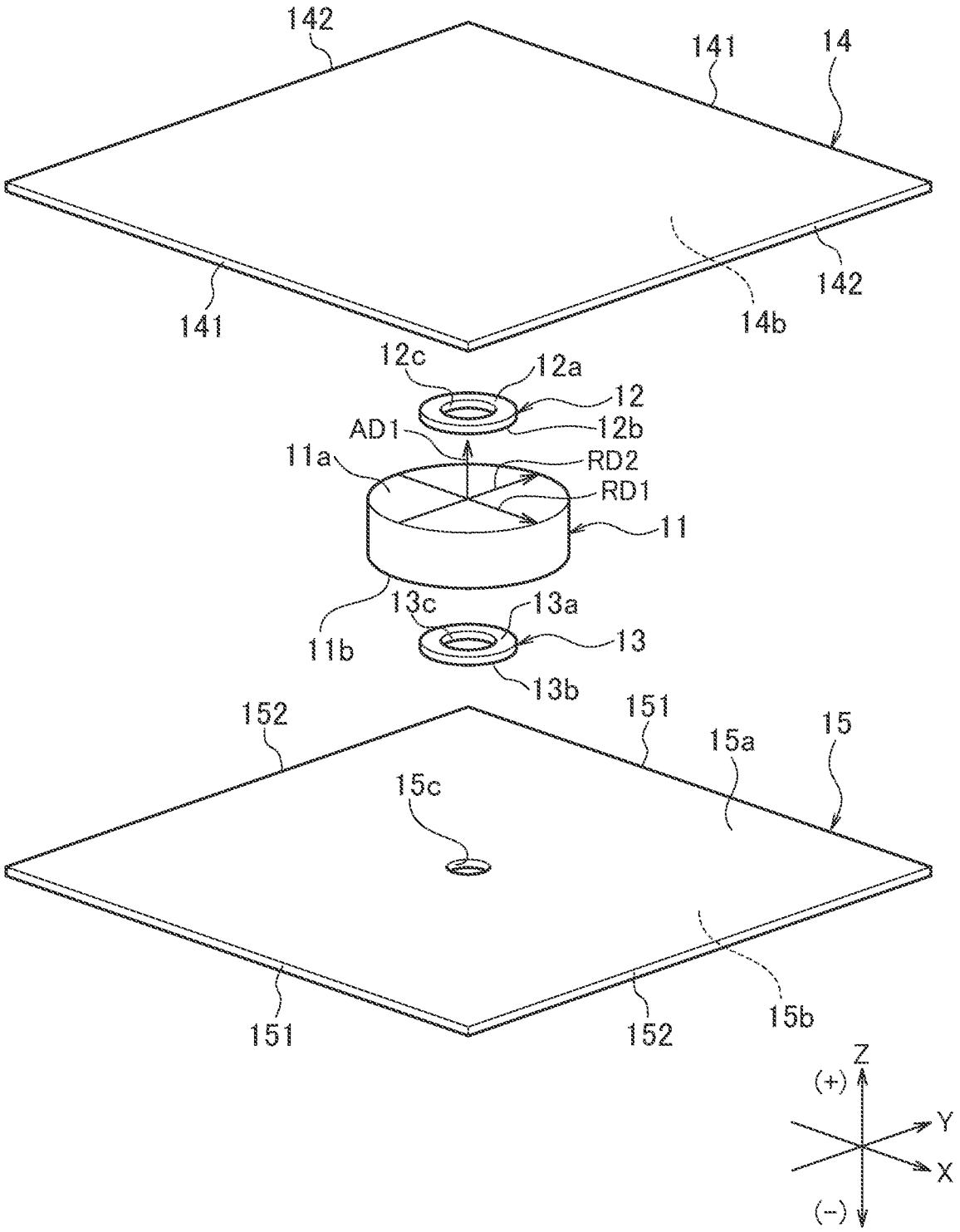
FIG. 3 is an exploded view of the thin antenna.

As illustrated in FIGS. 1 to 3, a thin antenna 10 includes an antenna element 11, a pair of insulating spacers (first and second spacers) 12, 13, and a pair of ground planes (first and second ground planes) 14, 15. The ground planes 14, 15 are formed larger than a top surface 11*a* and a bottom surface 11*b* of the antenna element 11, respectively. It is noted that the ground planes 14, 15 are also referred to as upper and lower ground planes, respectively.

As illustrated in FIG. 3, the antenna element 11 is formed in a solid circular column shape and is made of a conductive material such as metal (e.g., copper or iron).

An X-direction shown in FIGS. 1 to 3 is parallel to a first radial direction RD1 of the antenna element 11 (see FIG. 3). The X-direction is also parallel to first sides 141, 141 of the ground plane 14 and first sides 151, 151 of the ground plane 15 in the thin antenna 10. A Y-direction shown in FIGS. 1 to 3 is perpendicular to the X-direction and is parallel to a second radial direction RD2 of the antenna element 11 (see FIG. 3). The Y-direction is also parallel to second sides 142, 142 of the ground plane 14 and second sides 152, 152 of the ground plane 15 in the thin antenna 10. A Z-direction shown in FIGS. 1 to 3 is perpendicular to the X-direction and the Y-direction and is parallel to an axial direction AD1 of the antenna element 11 (see FIG. 3). The Z-direction is also perpendicular to an X-Y plane of each of the ground planes 14, 15 in the thin antenna 10. It is noted that II-II line in FIG. 1 is parallel to the second sides 142, 142 of the ground plane 14 and connects the midpoints of the first sides 141, 141 of the ground plane 14 to a center of the ground plane 14.

The antenna element 11 has the top surface 11*a* formed in a circular shape and located on a + side of the Z-direction, and the bottom surface 11*b* formed in a circular shape and located on a − side of the Z-direction. The top surface 11*a* faces the bottom surface 11*b*. In the thin antenna 10, the antenna element 11 is arranged such that the top surface 11*a* and the bottom surface 11*b* of the antenna element 11 face the ground planes 14, 15 via the spacers 12, 13, respectively. In other words, the antenna element 11 is sandwiched between the ground planes 14, 15 via the spacers 12, 13 in the Z-direction.

As illustrated in FIG. 2, a feeding point 16 to be connected to a feeding cable 17, which will be described later, is provided on the bottom surface 11*b* of the antenna element 11. A power is fed at the bottom surface 11*b* (bottom portion) of the antenna element 11. In this embodiment, the feeding point 16 is located at a center of the bottom surface 11*b*.

As illustrated in FIG. 2, the feeding cable 17 is a coaxial cable and includes a core wire 17*a*, an insulating coating 17*b* with which the core wire 17*a* is covered, a braid 18 with which the insulating coating 17*b* is covered. When the feeding cable 17 is connected to the thin antenna 10, the core wire 17*a* is connected to the feeding point 16 on the bottom surface 11*b* of the antenna element 11 and the braid 18 is connected to a bottom surface 15*b* of the ground plane 15. In this state, a distal end of the core wire 17*a* of the feeding cable 17 is inserted into an insertion hole 13*c* of the spacer 13 which will be described later, and a distal end of the insulating coating 17*b* of the feeding cable 17 is inserted into an insertion hole 15*c* of the ground plane 15 which will be described later.

As illustrated in FIG. 2, each of the spacers 12, 13 is formed in an annular thin plate shape and is made of an insulating material such as resin (e.g., synthetic resin). In this embodiment, an outer diameter and an inner diameter of the spacer 12 are 20 mm and 10 mm, respectively. Similarly, an outer diameter and an inner diameter of the spacer 13 are 20 mm and 10 mm, respectively. It is noted that the outer diameter and the inner diameter of each of the spacers 12 and 13 are not limited to 20 mm and 10 mm, respectively.

As illustrated in FIG. 3, the spacer 12 has a top surface 12*a* formed in an annular shape and located on the + side of the Z-direction, a bottom surface 12*b* formed in an annular shape and located on the − side of the Z-direction, and the insertion hole 12*c* penetrating through the spacer 12 along the Z-direction. The spacer 12 is attached on a bottom surface 14*b* of the ground plane 14, which will be described later, using a predetermined means. In the thin antenna 10, the top surface 12*a* of the spacer 12 contacts the bottom surface 14*b* of the ground plane 14 and the bottom surface 12*b* of the spacer 12 contacts the top surface 11*a* of the antenna element 11. When viewed from the X-Y plane, a center of the insertion hole 12*c* overlaps a center of the bottom surface 14*b* of the ground plane 14 and a center of the top surface 11*a* of the antenna element 11.

Similarly, the spacer 13 has a top surface 13*a* formed in an annular shape and located on the + side of the Z-direction, a bottom surface 13*b* formed in an annular shape and located on the − side of the Z-direction, and the insertion hole 13*c* penetrating through the spacer 13 along the Z-direction. The spacer 13 is attached on a top surface 15*a* of the ground plane 15, which will be described later, using a predetermined means. In the thin antenna 10, the top surface 13*a* of the spacer 13 contacts the bottom surface 11*b* of the antenna element 11 and the bottom surface 13*b* of the spacer 13 contacts the top surface 15*a* of the ground plane 15. When viewed from the X-Y plane, a center of the insertion hole 13*c* overlaps a center of the insertion hole 15*c* of the ground plane 15 and a center (feeding point 16) of the bottom surface 11*b* of the antenna element 11.

Although each of the spacers 12, 13 is formed in an annular shape in this embodiment, one of the spacers 12, 13 through which the feeding cable 17 is not inserted, may be formed in a disk shape instead of the annular shape. Also, when viewed from the X-Y plane, the spacers 12, 13 are smaller than the ground planes 14, 15, respectively. More specifically, the top surface 12*a* of the spacer 12 and the bottom surface 13*b* of the spacer 13 are smaller than the bottom surface 14*b* of the ground plane 14 and the top surface 15*a* of the ground plane 15, respectively. In this case, it is preferable that the spacers 12, 13 are smaller than the antenna element 11 when viewed from the X-Y plane. More specifically, it is preferable that the bottom surface 12*b* of the spacer 12 and the top surface 13*a* of the spacer 13 are smaller than the top surface 11*a* of the antenna element 11 and the bottom surface 11*b* of the antenna element 11, respectively. It is noted that each of the spacers 12, 13 may be larger than the antenna element 11 when viewed from the X-Y plane.

As illustrated in FIGS. 1 and 2, each of the ground planes 14, 15 is formed in a square thin plate shape and is made of a conductive material such as metal (e.g., copper or iron). In this embodiment, a length L1 of each of the first sides 141, 141 and the second sides 142, 142 of the ground plane 14 is 200 mm. Similarly, a length L2 of each of the first sides 151, 151 and the second sides 152, 152 of the ground plane 15 is 200 mm. It is noted that the length of each of the first sides 141, 141, 151, 151 and the second sides 142, 142, 152, 152 is not limited to 200 mm.

The ground plane 14 has a top surface 14*a* formed in a square shape and located on the + side of the Z-direction, and the bottom surface 14*b* formed in a square shape and located on the − side of the Z-direction. The ground plane 15 has the top surface 15*a* formed in a square shape and located on the + side of the Z-direction, a bottom surface 15*b* formed in a square shape and located on the − side of the Z-direction, and the insertion hole 15*c* penetrating through the ground plane 15 along the Z-direction.

In this embodiment, the ground plane 15 is a ground face (ground plane). For example, when the thin antenna 10 is mounted to a roof of a vehicle (not illustrated) or the like, the ground plane 15 is grounded on the roof or a metal body of the vehicle.

The ground planes 14, 15 are larger than the antenna element 11 when viewed from the X-Y plane. More specifically, the top surface 14*a* and the bottom surface 14*b* of the ground plane 14 are larger than the top surface 11*a* of the antenna element 11. The top surface 15*a* and the bottom surface 15*b* of the ground plane 15 are larger than the bottom surface 11*b* of the antenna element 11.

The thin antenna 10 is formed with a height H less than $\lambda/4$ in the Z-direction when a wavelength of an antenna frequency (electromagnetic wave) to be used in the thin antenna 10 is $\lambda$. More specifically, the thin antenna 10 is a low-profile antenna with the height H of about 11 mm. It is noted that the height H is a dimension that includes the height of the antenna element 11, thicknesses of the spacers 12, 13, and a thickness of the ground plane 14 in the Z direction. In other words, the height H is the height of the thin antenna 10 in the Z-direction, excluding a thickness of the ground plane 15.

In this embodiment, the antenna element 11, the spacers 12, 13, and the ground planes 14, 15 have the above-described shapes and dimensions when the thin antenna 10 is used for a frequency band between 0.815 GHz and 0.875 GHz. The shapes and dimensions of the antenna element 11, the spacers 12, 13, and the ground planes 14, 15 are adequately changed according to a desired frequency.

According to this embodiment, as illustrated in FIG. 2, the height H of the thin antenna 10 is reduced to less than $\lambda/4$ by the combination of the antenna element 11, the spacers 12, 13, and the ground planes 14, 15. The diameter of the antenna element 11 is determined according to a desired bandwidth. In other words, the thin antenna 10 is a low-profile antenna with a height H of about 11 mm.

Figure 4:
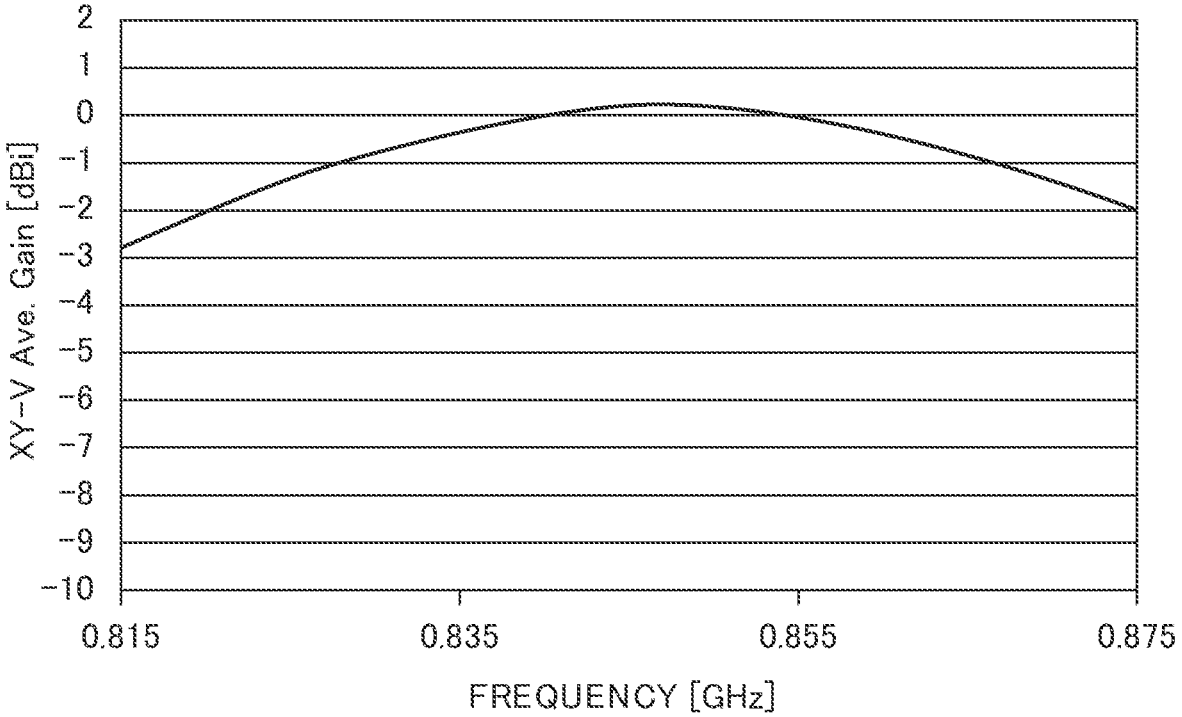
FIG. 4 is a diagram showing an average gain in a vertical polarization relative to a horizontal plane in the thin antenna.

As illustrated in FIG. 4, an analysis of an average gain in a vertical polarization (V polarization) relative to a horizontal plane (X-Y plane) shows that an average gain of the thin antenna 10 is more than −3 dBi in the frequency band between 0.815 GHz and 0.875 GHz. This enables the thin antenna 10 to have good radiation characteristics in the vertical polarization relative to the horizontal plane.

Figure 5:
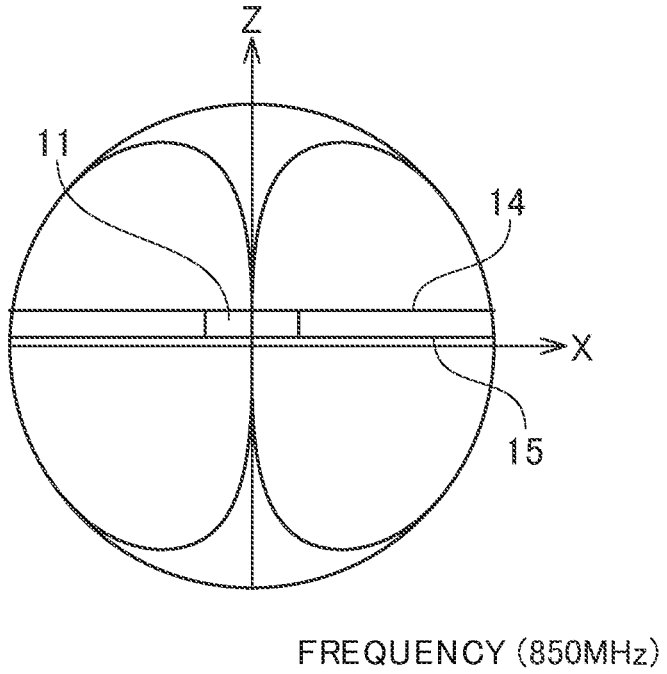
FIG. 5 is a diagram showing a radiation pattern of the thin antenna when a lower ground plane is the same size as an upper ground plane.

By forming the ground plane 14 and the ground plane 15 to the same size as each other, as illustrated in FIG. 5, a radiation pattern (radiation characteristics) on the + side of the Z-direction is the same as a radiation pattern (radiation characteristics) on the − side of the Z-direction in the thin antenna 10. This enables good communication in the horizontal plane.

Thus, according to this embodiment, the radiation characteristics in the vertical polarization relative to the horizontal plane can be made good while the height H of the thin antenna 10 is made low. In addition, by making the height H of the thin antenna 10 low, it is possible to install the thin antenna 10 in a limited space. Furthermore, it is possible to perform good communication (transmission and reception) in the horizontal plane. Therefore, the thin antenna 10 whose the height H is reduced, is suitable for use as an on-vehicle antenna.

Figure 6:
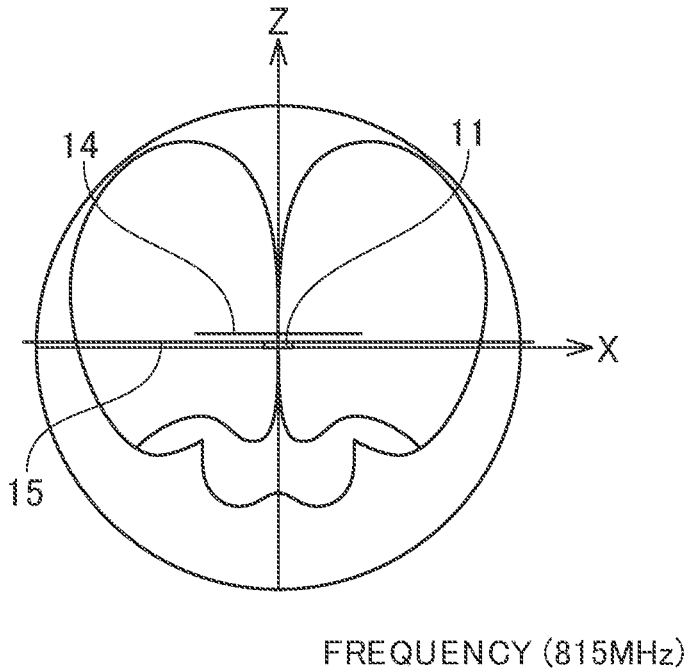
FIG. 6 is a diagram showing a radiation pattern of the thin antenna when the lower ground plane is larger than the upper ground plane.

Although the ground plane 14 and the ground plane 15 are formed to the same size as each other in this embodiment, the ground plane 15 may be formed larger than the ground plane 14. For example, the ground plane 14 is formed in a square shape with a side length L1 of 200 mm, and the ground plane 15 is formed in a square shape with a side length L2 of 600 mm. In this case, as illustrated in FIG. 6, a radiation pattern (radiation characteristics) that radiates strongly upward can be obtained. Furthermore, if the ground plane 15 is formed larger than the ground plane 14, a roof of a vehicle can be used as a ground plane of the thin antenna 10. In this case, the feeding point 16 is provided on the bottom surface 11*b* of the antenna element 11.

Figure 7:
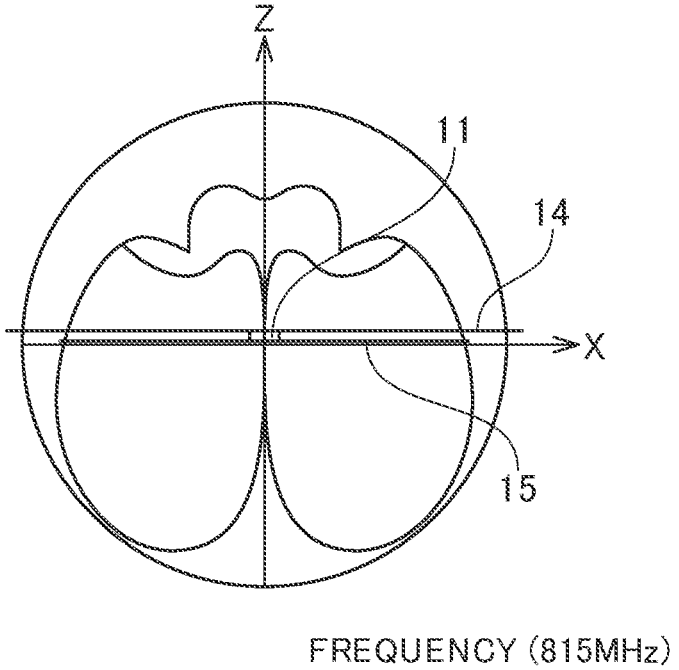
FIG. 7 is a diagram showing a radiation pattern of the thin antenna when the upper ground plane is larger than the lower ground plane.

Although the ground plane 14 and the ground plane 15 are formed to the same size as each other in this embodiment, the ground plane 14 may be formed larger than the ground plane 15. For example, the ground plane 14 is formed in a square shape with a side length L1 of 600 mm, and the ground plane 15 is formed in a square shape with a side length L2 of 200 mm. In this case, as illustrated in FIG. 7, a radiation pattern (radiation characteristics) that radiates strongly downward can be obtained. In this case, the feeding point 16 is provided on the top surface 11*a* of the antenna element 11.

It is preferable to provide the feeding point 16 on the larger of the two ground planes 14, 15. Since a radiation power is more stronger in a direction of the smaller of the two ground planes 14, 15, a radiation plane will not be affected by the feeding cable 17 and the like by providing the feeding point 16 on the larger of the two ground planes 14, 15.

Although the embodiment is described above, the disclosure is not limited to it. Various modifications are possible within the scope of the gist of the disclosure.

According to this embodiment, the antenna element 11 is made of the conductive metal and formed in the solid circular column shape, but the disclosure is not limited to this. The antenna element 11 may be made of the conductive metal and formed in a prismatic column shape (e.g., rectangular column shape) or the like. The antenna element 11 may also be formed in a hollow circular column shape, as long as the top surface 11*a* and the bottom surface 11*b* thereof are closed. The antenna element 11 only needs to be formed in a column shape. It is noted that the term "column" encompasses both of the circular column and the prismatic column.

According to this embodiment, each of the ground planes 14, 15 is formed in the square thin plate shape that is larger than the top surface 11*a* and the bottom surface 11*b* of the antenna element 11, but the disclosure is not limited to this. Each of the ground planes 14, 15 may be formed in a circular (round) or polygonal thin plate shape that is larger than the top surface 11*a* and the bottom surface 11*b* of the antenna element 11. In a case where a vehicle has a plastic roof, any one of the ground planes 14, 15 may be made up of a whole or part of a body of the vehicle. In a case where a vehicle has a metal roof, any one of the ground planes 14, 15 may be composed of a whole or part of the roof of the vehicle.

Furthermore, according to this embodiment, each of the spacers 12, 13 is formed in the annular thin plate shape, but the discloser is not limited to this. Each of the spacers 12, 13 may be formed in a polygonal thin plate shape. Also, an outer shape of each of the spacers 12, 13 may be formed in a polygonal shape.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A thin antenna comprising:

an antenna element formed in a column shape, and having a top surface and a bottom surface facing each other;

a first spacer made of an insulating material;

a second spacer made of an insulating material;

a first ground plane formed larger than the top surface of the antenna element; and a second ground plane formed larger than the bottom surface of the antenna element, wherein the first spacer is formed smaller than a bottom surface of the first ground plane, the second spacer is formed smaller than a top surface of the second ground plane, the first ground plane is disposed to face the top surface of the antenna element via the first spacer, the second ground plane is disposed to face the bottom surface of the antenna element via the second spacer, the antenna element is sandwiched between the first spacer and the second spacer, and a power is fed at one of the top surface and the bottom surface of the antenna element.

2. The thin antenna according to claim 1, wherein the antenna element is made of a conductive metal and formed in a circular column shape, and the first ground plane and the second ground plane are the same size as each other.

3. The thin antenna according to claim 1, wherein one of the first ground plane and the second ground plane is larger than the other of the first ground plane and the second ground plane.

4. The thin antenna according to claim 3, wherein the one of the first ground plane and the second ground plane is made up of a whole or part of a body of a vehicle.

* * * * *